United States Patent [19]

Hahn et al.

[11] 4,247,090

[45] Jan. 27, 1981

[54] COMBINED CORNER CLAMP AND SUPPORT

[76] Inventors: Roy C. Hahn, 3N555 West Ave., Bensenville, Ill. 60106; Ronald R. Hahn, 22880 N. Old Barrington Rd., Barrington, Ill. 60010

[21] Appl. No.: 74,444

[22] Filed: Sep. 11, 1979

[51] Int. Cl.[3] ..... B25B 1/20

[52] U.S. Cl. ..... 269/41; 269/76; 269/97; 269/295

[58] Field of Search ..... 269/41, 87.2, 95, 97, 269/71, 76, 111, 295; 83/761, 763

[56] References Cited

U.S. PATENT DOCUMENTS

| | | | |
|---|---|---|---|
| 600,118 | 3/1898 | Bruno | 269/41 |
| 2,908,300 | 10/1959 | Hahn | 269/41 |
| 4,145,006 | 3/1979 | Webb | 269/71 |

*Primary Examiner*—Robert C. Watson

*Attorney, Agent, or Firm*—Leitner, Palan, Lyman, Martin & Bernstein

[57] ABSTRACT

A support for a corner clamp which maintains two trim strips at a ninety degree angle is provided which allows pivoting of the clamped trim from a horizontal plane to a vertical plane. The corner clamp is mounted to the support so that the clamped trim may be rotatably adjusted in their plane.

11 Claims, 9 Drawing Figures

FIG. 1
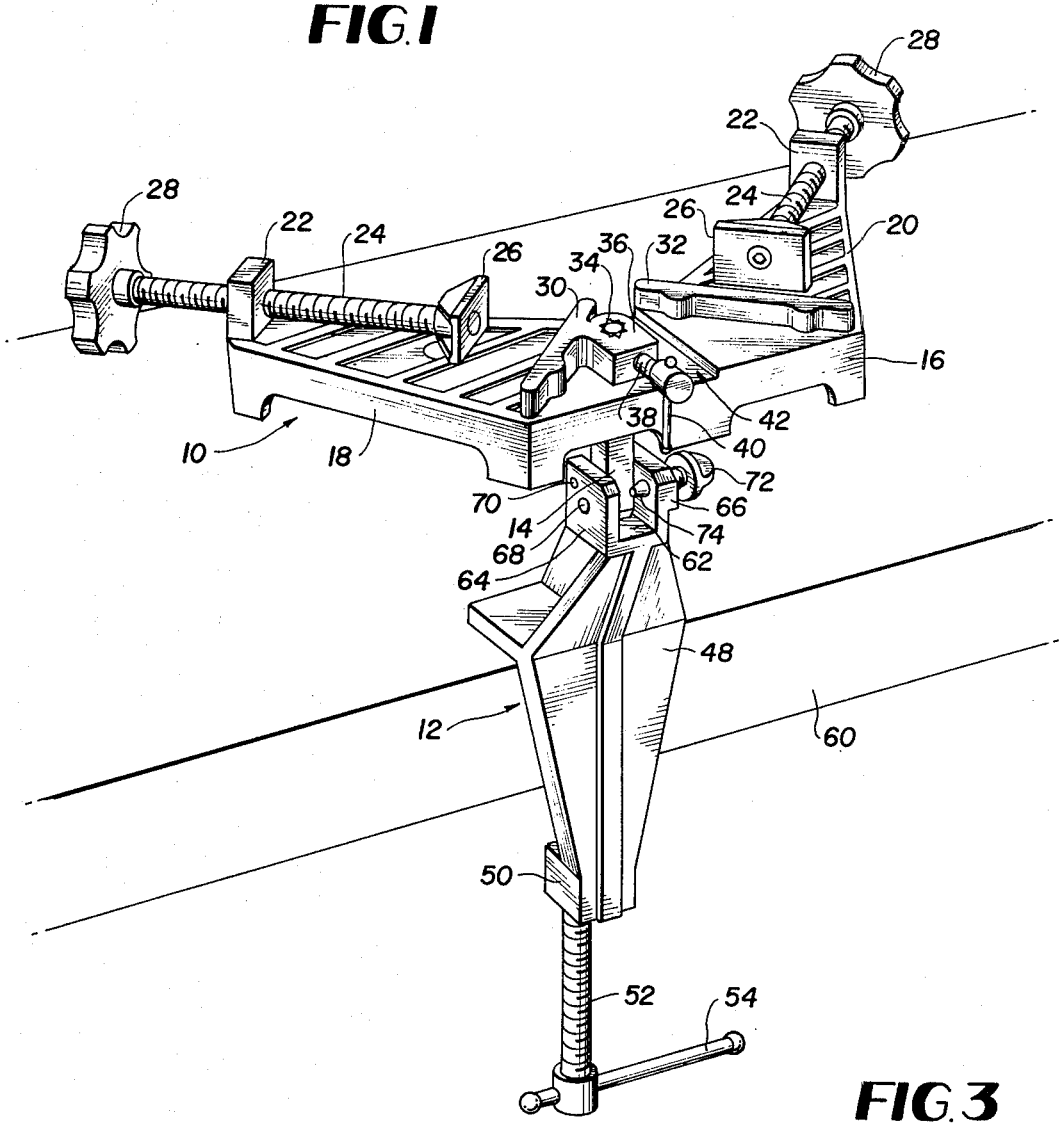
FIG. 3
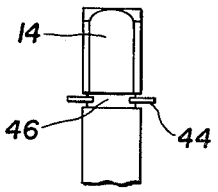
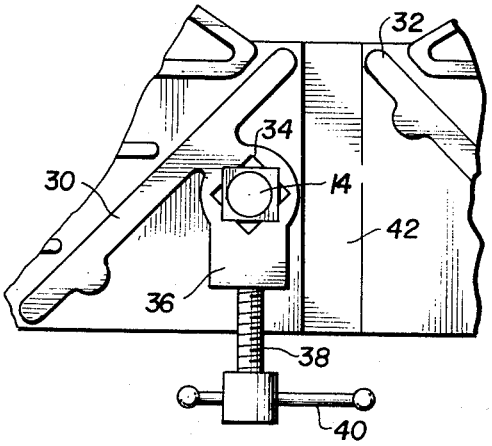
FIG. 2

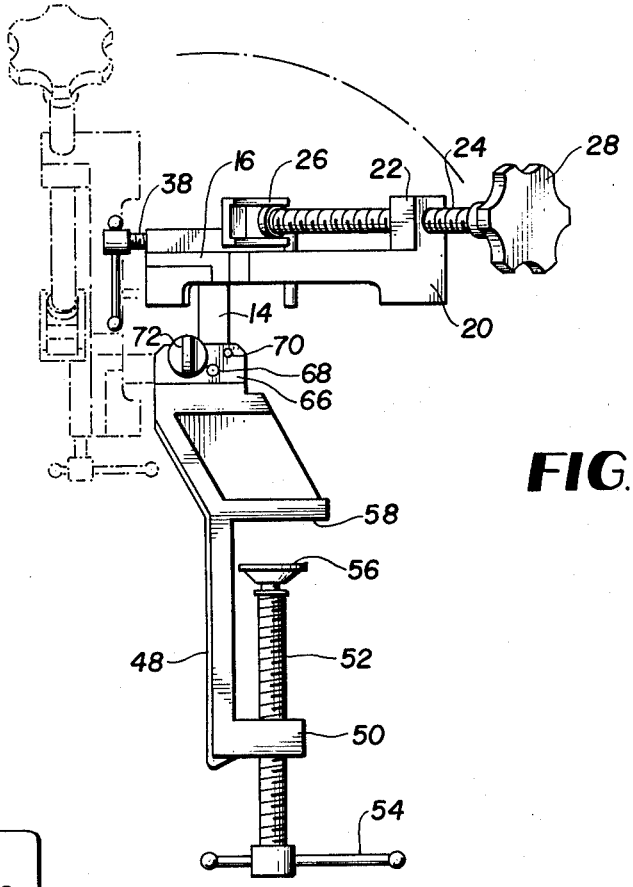
FIG. 4
FIG. 6
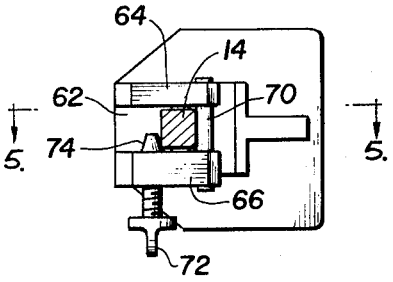
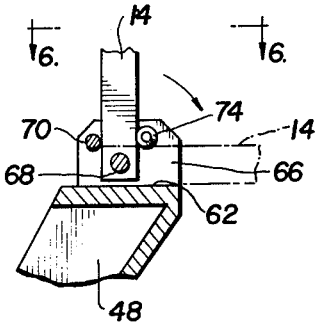
FIG. 5
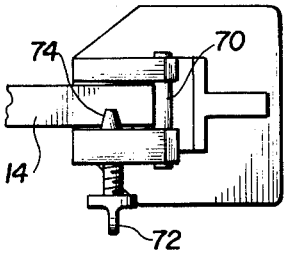
FIG. 7

COMBINED CORNER CLAMP AND SUPPORT

BACKGROUND OF THE INVENTION

The present invention relates generally to corner clamps and more specifically to a corner clamp and support for picture frames or trim.

Combined miter box and corner clamps for receiving and retaining frame members to be cut at a right or left forty five degree angle, and then positioned relative to each other at their mitered ends and retained securely for readible attachment at a ninety degree angles are well known. Typical examples are disclosed in U.S. Pat. No. 2,908,300, issued Oct. 13, 1959 and U.S. Pat. No. 4,056,030, issued Nov. 1, 1977. The resulting frame members are particularly suitable for use in framing pictures, screens, or trim for other purposes. These devices have been permanently anchored to work bench or other support services by screws, bolts, or the like. Although the clamping of the frame members in a horizontal plane facilitates the alignment and clamping as well as the cutting from either end, the securing of the devices together by nailing in the horizontal plane is inconvenient as well as difficult.

The prior art also includes a miter machine and corner clamp having a universal base anchored to a work bench or the supporting surfaces by screws, bolts, or the like. The universal base allowed complete rotation in a given plane as well as pivoting of the plane from a horizontal to a vertical position. These universal bases by providing an infinite degree of adjustability use locking mechanisms which generally come loose during nailing, drilling or sawing. A positive lock was not capable by providing the universality of the rotation in the working plane. Also the sophistication of the mechanisms for the universal base duly increases the cost of the combined miter box and clamp. As with the planar fixed miter box and clamp, the universal bases are anchored permanently to the work bench or other supporting surfaces. This is undesirable for many homeowners who do not wish to dedicate a portion of their work tables to a specialized item.

Thus, there exists a need for a corner clamp which is readily attached and removed from a work bench or supporting surface which provides the adjustability from a horizontal to a vertical plane and rotation within the plane.

SUMMARY OF THE INVENTION

Therefore, it is an object of the present invention to provide a corner clamp and support which is readably attachable and detachable from a work bench.

Another object of the present invention is to provide a support for a corner clamp which may be pivoted from a horizontal to a vertical plane.

Still another object of the present invention is to provide a corner clamp and support which allows pivoting the clamped corner from a horizontal to a vertical plane and rotation of clamped elements in the plane.

A further object of the present invention is to provide a corner clamp and support which allows pivoting from a horizontal to a vertical plane and rotation within the plane which can be manufactured for a reasonable cost.

A still further object of the present invention is to provide a corner clamp which positively locks the clamp in preselected rotational positions.

An even further object is to provide a corner clamp with a pivot lock to assure that the corner clamp is in a horizontal or vertical plane.

These and other objects of the present invention are attained by providing a support with means to clamp the support to a work bench, interconnecting the support to the platform of the corner clamp by a post which is pivotally connected to the support so as to pivot between a first and second stop ninety degrees apart and configuring the post and the socket on the platform of the corner clamp so as to define a plurality of fixed positions for relative positioning of the platform at different angles within its plane. The post and socket on the platform are of polygon cross-sections and defined at least three relative angular positions forty five degrees apart. The post is pivotally mounted between a pair of space projections extending perpendicular from a surface which defines the first stop. The second stop extends between the projections. A lock comprising a threaded element extends through one of the projections into the space there between in a line which bisects the angle between the first and second stops. The thread locking element has a tapered end which engages and slides along a surface of the post to wedge the post against the stops to assure positioning of the platform in either a horizontal or vertical plane.

Other objects, advantages and novel features of the present invention will become apparent from the following detailed description of the invention when considered in conjunction with the accompanying drawings.

BRIEF DESCRIPTION OF THE DRAWINGS

FIG. 1 is a perspective view of the combined corner clamp and support of the present invention.

FIG. 2 is a fragmental top plan illustrating the post and socket relationship.

FIG. 3 is a fragmental side view of the post and collar.

FIG. 4 is a side view of the combined corner clamp and support with the corner clamp in a horizontal plane and a phantom illustration in a vertical plane.

FIG. 5 is a fragmental side view of the post in a first position and phantom illustration of a second position.

FIGS. 6 and 7 are top views taken along line 6—6 of FIG. 5 for the first and second positions, respectively.

DESCRIPTION OF PREFERRED EMBODIMENTS

Figure 8:
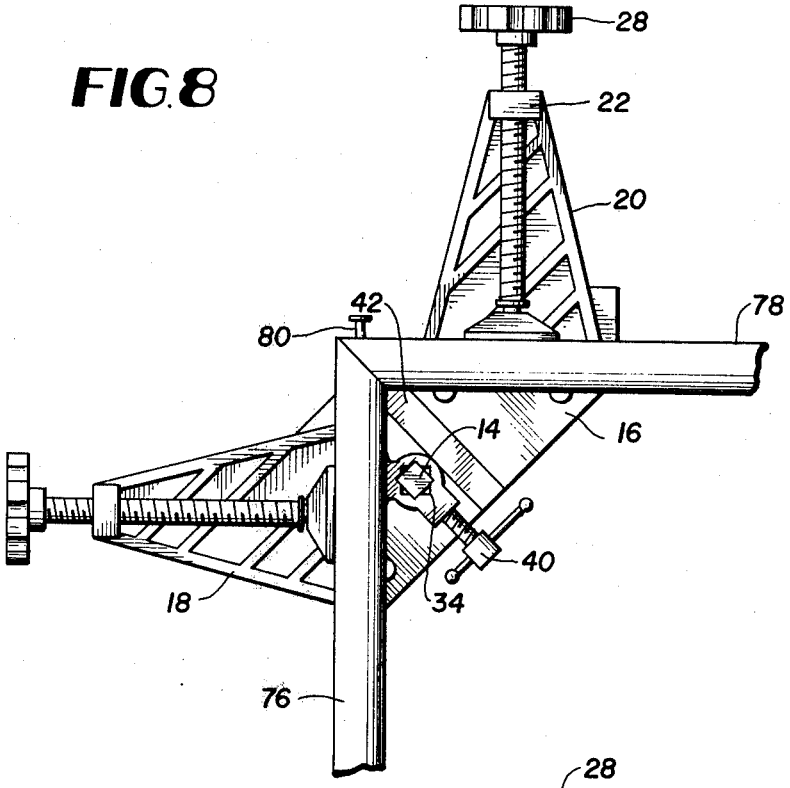
FIGS. 8 and 9 are side views of the corner clamp in two position ninety degrees apart in the vertical plane.

FIG. 1, which illustrates preferred embodiment of the corner clamp and support, shows a corner clamp 10 connected to a support structure 12 by a post 14. The corner clamp 10 includes a platform 16 having spaced arms or projections 16 and 18 disposed at an angle of ninety degrees relative to each other. Projecting upwardwardly from the ends of arms 18 and 20 is an internally threaded lug 22 for receiving a threaded adjusting screw 24. Each adjusting screw 24 is provided at its interclamping end with a wide clamping jaw 26 freely swiveled thereon. The other end of the screw 24 beyond the lug 22 includes a handle 28 for rotating the screw and longitudinally moving its clamping jaw 26. At the adjacent end of arms 18 and 20 are angularly arranged upright shoulders 30 and 32 respectively projecting vertically above the surface of the platform 16. The shoulders 30 and 32 are arranged at an angle of ninety degrees relative to each other and are opposed the clamping jaws 26 to cooperate therewith to clamp a frame sanctionarily there between.

A socket 34 in upright portion 36 of platform 16 receives the post 14. A threaded locking screw 38 extends through the side of upright 36 into socket 34 to engage and securely lock the post 14 against the opposed side of socket 34. As illustrated specifically in FIG. 2, the post 14 has a polygon cross-section, for example a square, and socket 34 also has a polygon cross-section, for example a sexdecagon or sixteen sides. The relationship of the cross-section of the post 14 and socket 34 define eight angular positions of the platform 16 relative to the post 14 each forty-five degrees apart.

Also as noted in FIG. 2, a channel 42 is provided in the top surface of platform 16 to accommodate a cutting saw blade. Channel 42 bisects the ninety degree angle formed by shoulders 30 and 32 and traverses the spaces between their adjacent ends. This allows for triming of either of the clamped length of trim if they should not be properly mitered. Although miter structure is not shown in the present application, such attachments may be provided and channel 42 allows for a clean or complete cut through the width of the piece of trim to be mitered. Typical mitering structure which may be added to or form a part of the corner clamp is illustrated in the previously noted U.S. patents.

As illustrated in FIG. 3, post 14 has a collar 44 secured thereto in an annulus channel 46. The bottom of platform 16 rests on collar 44 and define specifically the distance from the pivot point of post 14 such that the platform will not collide or contact the support structure 12 when being pivoted from a horizontal to a vertical position or plane.

Support 12 includes a base 48 having an outwardly projecting internally threaded lug 50 receiving a threaded adjusting screw 52. Provided at the outer end of adjusting screw 52 is a handle 54 and on the inner end of screw 52 beyond the lug 50 is a wide clamping jaw 56 freely swiveled on the end thereof. An upright also projecting from the base 48 has a planar surface 58 which is opposed the clamping jaw 56 as illustrated in FIG. 4. Screw 52 is pivoted to adjust the clamping jaw 56 so as to clamp a work bench or other supporting surface or structure illustrated in FIG. 1 as 60 there between.

The top end of base 48 terminates in a planar surface 62 substantially parallel to the planar surface 58. Extending vertically up from the planar surface 62 are space projections 64 and 66. The post 14 is pivotally connected between projections 64 and 66 by pin 68. Whereas planar surface 62 forms a first stop for the pivoting post 14, a rod 70 extending between the projections 64 and 66 act as a second stop defining a position for the post 14 ninety degrees from the first stop 62. A thumb screw 72 is received in a threaded aperture in projection 66 and extends into the area between projections 66 and 64. The end of thumb screw 72 is tapered at 74 to engage and slide along a surface of post 14 to lock post 14 against stop 70 or stop surface 62 as illustrated in FIGS. 6 and 7 respectively. The tapered end 74 wedges the post 14 against the stops and assures the vertical or horizontal position of the platform 16. By locating the thumb screw 72 along a line bisecting the horizontal and vertical positions as illustrated in FIG. 5, it is equally spaced from the stop 70 and the stop surface 62 and thus a single lock may be used to secure the post 14 in its two defined positions. The pivotal point 68 and the lock 72 each lie on a line that bisects the angle between stops 70 and stop surface 62. The post 14 locked against stop 70 is illustrated in FIG. 5 and against stop surface 62 in FIG. 6.

The importance of the elements of the present invention will become apparent in the description of the use of the present corner clamp and support in joining two strips of trim. Initially the support 10 is positioned having planar surface 58 on the top of a work bench, for example 60, and adjusting screw 52 so as to clamp the work bench 60 between the surface 58 and the jaw 56. The post 14 is positioned against stop 70 and locked thereagainst by thumb screw 72 in its vertically extended position as illustrated in FIGS. 1, 4, 5 and 6. Platform 16 of corner clamp 10 is then positioned on post 14 in a substantially horizontal position with channel 42 parallel to the plane through which post 14 pivots. Two frame or trim pieces of 76 and 78 are clamped between shoulders 30 and 32 in their respective jaws 26. Once the pieces 76 and 78 are aligned, mated and held firmly to the platform 16, thumb screw 72 is retracted and the platform 16 and post 14 are rotated down such that post 14 engages stop surface 62. Thumb screw 72 is then extended into the space between projections 66 and 64 with tapered end 74 engaging the post 14 to lock it in its horizontal position as illustrated in phantom in FIGS. 4 and 5 and solid in FIG. 7.

Figure 9:
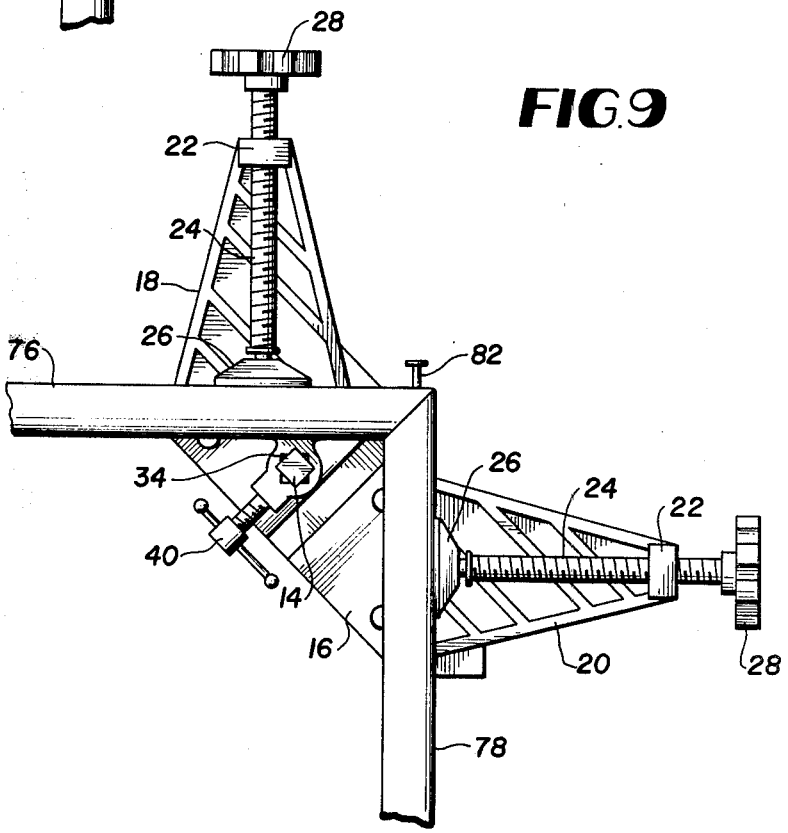

Lock screw 38 is then loosened and the platform 16 is removed from post 14 and rotated forty-five degrees to the left and reinserted on post 14. Lock screw 38 is then tightened to again secure the platform 16 to the post 14. This position is illustrated in FIG. 8 with trim 76 vertical and trim 78 horizontal. A fastener, for example, nail 80 is then driven through piece 78 into piece 76 to secure the two trim pieces together. Once the fastener 80 is driven into piece 76, lock screw 38 is retracted and platform 16 is removed from post 14 and rotated ninety degrees to the right. This ninety degree rotated position is illustrated in FIG. 9. Platform 16 is then remounted back onto post 14 and then lock screw 38 is threaded to engage post 14 and lock it in the second position with trim piece 76 horizontal and trim piece 78 vertical. A fastener for example a nail 82 is then driven through 76 into 78 to complete the securement of the two pieces together.

The provision of the polygon shaped post 14 and socket 34 provides a positive lock of the angular position of platform 16 on post 14 which will not be affected by hammering or other forms of driving a fastener into the pieces secured to the corner clamp 10. Although the repositioning of the platform 16 in the vertical plane as illustrated in FIGS. 8 and 9 were described for applying fasteners to the two trim pieces, other processes may be performed on the pieces while clamped. For example, holes may be bored or other applicable processing steps taken. Once the fasteners have been applied in both the positions in FIGS. 8 and 9, the jaws 26 are opened and the completed corner removed.

From the preceding description of the preferred embodiment, it is evident that the objects of the invention are attained in that a corner clamp and support is provided which readily allows adjustment of the clamp from a horizontal to a vertical position as well as providing a positive lock in two angular positions in the vertical plane. Although the invention has been described and illustrated in detail, it is clearly to be understood that the same is by way of illustration and example only and is not to be taken by way of limitation. For example, the support 12 is shown affixed to a horizontal surface 60, it may equally be applied to a vertical surface. The relationship of the stop surface 62 and stop 70 will allow a horizontal and vertical position to be defined and the relationship of the geometry of the cross-section of post 14 and socket 34 allows the positions of FIGS. 8 and 9 to similarly be defined for the attachment of the support 12 to a vertical surface. The spirit and scope of this invention are to be limited only by the terms of the appended claims.

What is claimed:

1. A combined work holder and support for producing right angle corners from strips comprising:

a platform having a pair of shoulders disposed relative to each other at an angle of ninety degrees;

clamping means on said platform for cooperating with a respective shoulder to clamp a strip therebetween;

a support having means for removably securing said support to a structure;

a post pivotally mounted to said support to rotate about a horizontal axis;

means on said platform for detachably connecting said platform to said post;

a pair of stop means disposed relative to each other at an angle of ninety degrees on said support for defining respectively a first and a second position of said post ninety degrees apart whereby said platform may be pivoted from a horizontal position to a vertical position; and a lock means located along an axis bisecting the angle between said pair of stop means for locking said post in either said first or second positions.

2. An apparatus as set forth in claim 1 wherein said support support, a thread lug integral with said support opposite said first planar surface and a clamping jaw threadly received in said lug for cooperating with said first planar surface to clamp said support to a structure.

3. An apparatus as set forth in claim 2 wherein said first stop means is a second planar surface integral with said support and parallel to said first planar surface, and including a pair of spaced projections extending perpendicular from said second planar surface, said post being pivotally mounted between said projection.

4. An apparatus as set forth in claim 3 wherein said second stop means extends between said projections and said lock means is a screw threadly received and traversing one of said projections into the space between said projections.

5. The apparatus as set forth in claim 4 wherein said screw includes a tapered end for engaging and sliding along the surface of said post to wedge said post against said stop means.

6. A combined work holder and support for producing right angle corners from strips comprising:

a platform having a pair of shoulders disposed relative to each other at an angle of ninety degrees;

clamping means on said platform for cooperating with a respective shoulder to clamp a strip therebetween;

a support having means for removably securing said support to a structure;

a post pivotally mounted to said support to rotate about a horizontal axis;

means on said platform for detachably connecting said platform to said post and including a collar on said post which engages the bottom of said platform; and a pair of stop means on said support for defining respectively a first and a second position of said post ninety degrees apart whereby said platform may be pivoted from a horizontal position to a vertical position.

7. The apparatus as set forth in claim 6 wherein said post and said socket cooperate to define at least three positions forty five degrees apart.

8. The apparatus as set forth in claim 6 wherein said post has a square cross-section and said socket is a sexdecagon.

9. The apparatus as set forth in claim 6 wherein said connecting means includes a screw threadly received in said platform and extending into said socket for cooperating with opposed portions of said socket to clamp said post there between.

10. The apparatus as set forth in claim 1 wherein said shoulders are separated at their adjacent ends by a gap and said platform includes a channel in its top surface bisecting the angle between said shoulders for accommodating a cutting saw blade therein.

11. A combined work holder and support for producing right angle corners from strips comprising:

a platform having a pair of shoulders disposed relative to each other at an angle of ninety degrees;

clamping means on said plat for cooperating with a respective shoulder to clamp a strip therebetween;

a support having means for removably securing said support to a structure;

a post having a polygonal cross-section pivotally mounted to said support to rotate about a horizontal axis;

a pair of stop means on said support for defining respectively a first and a second position of said post ninety degrees apart whereby said platform may be pivoted from a horizontal position to a vertical position; and means on said platform having a polygonal socket for detachably connecting said platform to said post and cooperating with said post to define a plurality of fixed angular positions of said platform relative to said post in the plane of the platform.

* * * * *